US007002160B1

(12) United States Patent
Glass et al.

(10) Patent No.: US 7,002,160 B1
(45) Date of Patent: Feb. 21, 2006

(54) SEXTUPLET QUADRUPOLE LENS SYSTEM FOR CHARGED PARTICLE ACCELERATORS

(75) Inventors: Gary A. Glass, Lafayette, LA (US); Alexander D. Dymnikov, Lafayette, LA (US)

(73) Assignee: University of Louisiana at Lafayette, Lafayette, LA (US)

( * ) Notice: Subject to any disclaimer, the term of this patent is extended or adjusted under 35 U.S.C. 154(b) by 0 days.

(21) Appl. No.: 10/982,022

(22) Filed: Nov. 5, 2004

Related U.S. Application Data

(60) Provisional application No. 60/518,190, filed on Nov. 7, 2003.

(51) Int. Cl.
*H01J 49/42* (2006.01)

(52) U.S. Cl. ..... 250/396 R

(58) Field of Classification Search ..... 250/396 R, 250/396 ML, 310, 311, 492.21
See application file for complete search history.

(56) References Cited

U.S. PATENT DOCUMENTS 4,710,722 A * 12/1987 Jahnke ..... 315/501
5,362,968 A * 11/1994 Miyoshi et al. ..... 250/396 R

* cited by examiner

*Primary Examiner*—Kiet T. Nguyen
(74) *Attorney, Agent, or Firm*—Kean, Miller, Hawthorne, D'Armond, McCowan & Jarman LLP; Russell O. Primeaux; Henry E. Naylor

(57) ABSTRACT

A sextuplet quadruple lens system for focusing charged particles, which lens system is comprised of two symmetrical triplet sets of lens.

5 Claims, 6 Drawing Sheets

SEXTUPLET QUADRUPOLE LENS SYSTEM FOR CHARGED PARTICLE ACCELERATORS

CROSS-REFERENCE TO RELATED APPLICATIONS

This application is based on Provisional Application U.S. Ser. No. 60/518,190 filed Nov. 7, 2003.

FIELD OF THE INVENTION

The present invention relates to a sextuplet quadruple lens system for focusing charged particles, which lens system is comprised of two symmetrical triplet sets of lens.

BACKGROUND OF THE INVENTION

Charged particle focusing systems have many valuable uses, including those wherein the charged particles are accelerated. For example, they are used: in microprobe systems to measure the concentration of elements in a sample; to provide one or two dimensional composition and structure maps using: PIXE (Particle Induced X-ray Emission), in STIM (Scanning Transmission Ion Microscopy); for tissue analysis of biological samples etc. High energy focused ion beam (HEFIB) microprobes have developed into very powerful analytical tools in recent years. The lateral resolution of microprobes is improved toward the submicron regime requiring high-quality probe-forming systems. Like all charged particle accelerator system, the HEFIB system is composed of certain basic components. Such basic components include: (i) a source of charge particles; (ii) a means for accelerating the charged particles; (iii) a tube pumped to a partial vacuum in which the beam of accelerated charged particles travel; (iv) a lens system for focusing the charged particle beam; and (v) a target chamber.

The focusing systems for many charged particle systems are comprised of multiple quadrupole lenses, each lens having two electrostatic or magnetic poles placed in parallel with the optical axis. A strong lens effect can be obtained owing to the fact that the main component of the electrostatic or magnetic field acts perpendicularly to the beam axis of charged particles. In its single stage configuration, however, the quadrupole lens is extremely asymmetrical, because it acts as a convergent (convex) lens in the XZ-plane and as a divergent (concave) lens in the YZ-plane. Therefore, when the quadrupole lens is used for beam convergence in an ion microprobe mass analyzer, electron and ion beam lithography system, Auger electron spectroscopy system, x-ray microanalysis system or the like, it has to be combined with like lenses in two, three or more stages. The great majority of lens systems for MeV energy systems is accomplished by quadrupole lenses, the great majority of which employ various combinations of magnetic quadrupole lenses, including doublet, triplet, quadruplet and quintuplet. The most popular quadrupole systems are the Russian Quadruplet and the Oxford Triplet. The Russian Quadrupole configuration is popular because of its symmetry and its orthomorphic character that permits the use of circular object diaphragms. The Russian Quadruplet consists of a set of four quadrupoles (magnetic or electrostatic), which alternating polarities. The two outer ones are coupled together, with the length $l_1$ and the excitation $K_1=K_4$, as are the central ones, which the length $l_2$ and the excitations $K_2=K_3$. The separation between the first and the second lenses and the third and the fourth is $s_1$, and the separation between the middle lenses is $s_2$.

The characteristics and throughput of the aforementioned charged particle beam apparatuses improve in proportion as the beam current value rises when the beam is converged to a minute diameter. Insofar as there are no problems regarding the source size and radiation current, the beam current can be increased solely by enlarging the effective beam converging angle. The size of the beam converging angle is, however, limited by the aperture (spherical) aberration of the lens. For optimum spatial resolution a small beam-spot is required, but because of aberrations, which are present to some extent in all designs of probe-forming systems, this can typically only be achieved at the expense of a reduction in beam current.

Thus, one of critical requirements for the components of a microbeam facility is low aberration/high demagnification probe-forming systems. While a variety of conventional quadrupole configurations exist, including quadrupole doublets, triplets, and quadruplets all suffer from the same drawback of not being able to adjust the focal length once the lens system is set in place within the beam line apparatus.

Therefore, there exist a need in the art for a quadruple lens system that will allow for the adjustment of focal length after the lens system is set in place in order to adjust the focusing system to mitigate intrinsic aberration of the lenses to achieve a optimum small beam spot.

SUMMARY OF THE INVENTION

In accordance with the present invention there is provided a quadrupole lens system comprised of six quadrupole lenses in a linear configuration comprised of two triplets, such that:

i) the focusing (F) and defocusing (D) capabilities of the lenses in one plane alternate F-D-F-D-F-D; and ii) the lens excitations are ordered A-B-C—C-B-A; and iii) the lengths of the lenses ($l_j$) and the distances between lenses ($s_k$) are ordered as $l_1$-$s_1$-$l_2$-$s_2$-$l_3$-$s_3$-$l_3$-$s_2$-$l_2$-$s_1$-$l_1$; and iv) every two identical lenses are rotated 90 degrees from each other.

DETAILED DESCRIPTION OF THE INVENTION

The sextuplet lens system of the present invention will have substantially the same demagnification and the same focal lengths and the same spherical aberration in both planes as the Russian Quadruplet quadrupole lens configuration. The primary advantage of the sextuplet lens system of the present invention is that it has the capability to change demagnification over a wide range from about 1 to about 1000 by changing only the excitation of the middle lenses. The sextuplet lens system of the present invention also allows one to obtain a point crossover between the middle lenses with a corresponding minimum sensitivity to the relative rotation of both triplets around the longitudinal axis.

Figure 1:
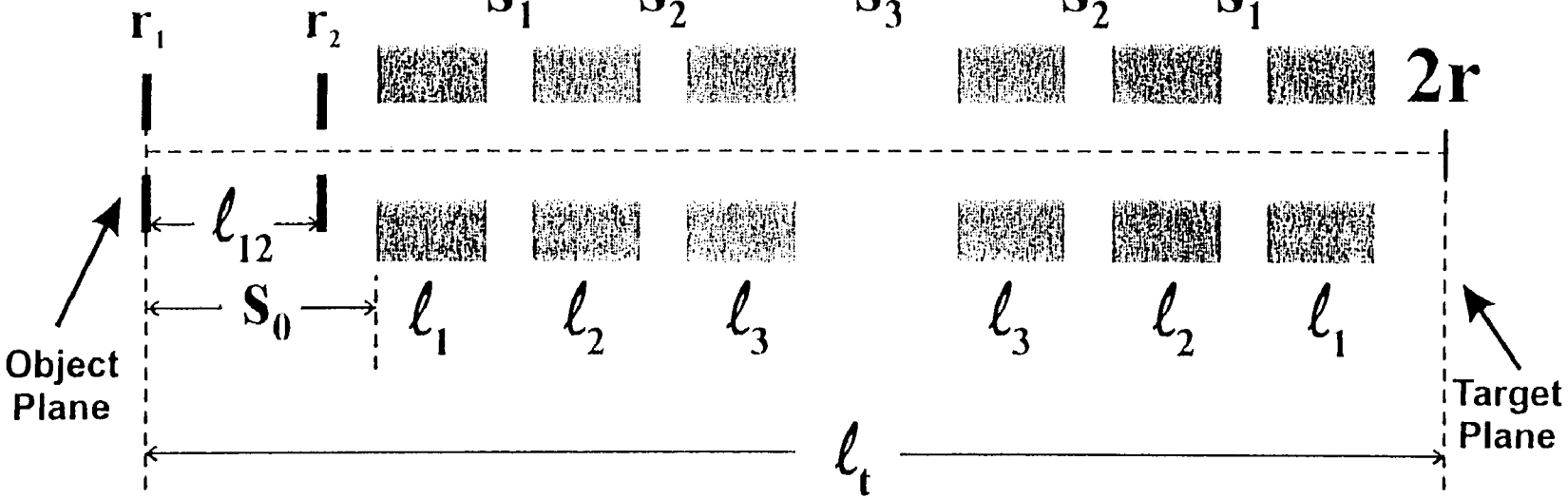
FIG. 1 hereof shows the geometry of a microprobe with a preferred configuration of two symmetrically related triplets of the quadrupole sextuplet lens system of the present invention.

The preferred configuration of the lens system of the present invention can best be described with reference to FIG. 1 hereof. FIG. 1 represents a cross-sectional view along the longitudinal axis of a microprobe. The six quadrupole lenses are represent in two symmetrical pairs of triplets wherein the length of outermost lenses 1 and 6 are equal, the lengths of the middle lenses in each triplet 2 and 5 are equal, and the length of the innermost lenses of each triplet 3 and 4 are equal. Also the spacing between lenses 1 and 2 and between 5 and 6 are equal, and the spacing between lenses 2 and 3 and between 5 and 6 are equal. $r_1$ is the radius of the object slit, $r_2$ is the radius of the diverging slit, $l_{12}$ is the distance between the object and diverging slits. It will be understood that the sextuplet lens system of the present invention can be comprised of any combination of magnetic and electrostatic lenses. For example, they can be all magnetic, all electrostatic, or a combination thereof.

The sextuplet system of the present invention will have substantially the same demagnification and the same focal length in both planes. For a first mode of excitations, they have negative demagnification in both planes and for a second mode the demagnification becomes positive. The systems with one positive demagnification and one negative demagnification (T) and those with both positive demagnifications have a minimum spot size if the distance between the last and last but one lenses is as small as possible and the distance between the last but one and the preceding lenses is $\approx(0.25–0.5)\ 1_{tot}$ wherein $1_{tot}$ is the total length of the lens system. That is, the distance between the object and the target. The absolute value of the demagnification in separated triplets is three to four times higher than in the best non-separated triplets, whereas the separated Russian Quadruplet configuration has the advantage over the separated triplet because it has a five to ten times greater demagnification. It is possible to obtain a short focal length with the separated Russian Quadruplet configuration system with a demagnification of approximately 500 for $1_{tot}$=6 meter. Therefore, using non-separated triplet and Russian Quardruplet configurations it is possible to obtain a micron beam size, but with a separated triplet lens system of the present invention attainment of sub-micron beams are possible. Preliminary calculations show that in the separated Russian Quadruplet configuration it is possible to obtain 20–100 nanometer beams. The same resolution is possible with the sextuplet configuration of the present invention. The sextuplet configuration of the present invention is more flexible and has about three times less spherical aberration that a Russian Quadruplet configuration.

While electrostatic and magnetic quadrupole lenses can be used in the practice of the present invention, electrostatic quadrupole lenses are preferred because they offer various advantages when compared to magnetic lenses. For example, they are amenable to miniaturization, whereas magnetic systems are not because of the space required for exciting coils, thereby liberating more space in the specimen chamber. Electrostatic lenses also do not suffer from hysteresis effects. Further, negligible current is drawn from the power supply, and stable voltage is more readily achieved for electrostatic lenses than stable current for magnetic lens systems. Further, the field strength required for focusing the beam onto the target using electrostatic lenses is independent of ion mass, thus being ideally suited for heavy-ion beams. Electrostatic lenses can also be constructed from industrial grade material that facilitates reproductions. It will be understood that while electrostatic lenses are preferred, the instant invention can be practiced with all electrostatic lenses, all magnetic lenses, or any combination thereof.

A lens system is defined as optimal if the lens system gives the maximum beam current for a give brightness and a given beam spot size. For these given values, the maximum beam current is limited by the lens aberrations and slit scattering. If the energy of the spread of the beam is on the order of 1 part per $10^4$ or better, then the effects of spherical aberrations dominate over chromatic aberrations for small beam spot sizes.

To compare the performance of each lens system, independent of the associated accelerator systems and its parameters, the aberration coefficients need to be expressed in terms of image coordinates. As they appear in terms of object coordinates, these coefficients will show a wide variation from system to system, being functions of the magnification. In practice, the aberrations are determined almost entirely by the convergence angles at the image and, since these angles also determine the current available for a given spot size and given brightness of the source, the aberration coefficients in terms of image coordinates describe the actual performance of the lens system.

For a microprobe system, upon entering the microprobe, the beam is collimated, first by an object diaphragm placed in the beam at the entrance to the microprobe in order to limit the area of the focused beam and second by an aperture diaphragm placed before the entrance to the microprobe lens in order to limit the divergence. Care is required in the choice of apertures and slits, in order to minimize the effects of "slit scattering". The advantage of using large demagnifications is that the object slit size can be relatively large and slit scattering becomes less important. There are four spherical aberration coefficients (cs) in the x- and y-planes:

$$Cs_1=x/x_0'^3=cs_x$$

$$Cs_2=y/y_0'^3=cs_y$$

and two cross terms $cs_{xy}=cs_{yx}$, for a stigmatic quadrapole multiplet. As stated previously, most ionfocusing systems utilize doublets, triplets and quadruplets, but there are no known systems that employ a pair of triplets. For each of these known systems, the spherical aberration coefficients, $Cs_1$ and $Cs_2$, are not equal. The parameter, C, is defined as the maximum value of $|Cs_1|$ and $|Cs_2|$.

Unlike conventional quadrupole multiplet lens systems wherein the spherical aberration coefficients are not equal, the spherical aberration coefficients of the sextuplet lens system of the present invention are substantially equal. That is $|Cs_1|=|Cs_2|=C=C_6$, and are significantly less than the coefficient C for doublets, triplets and quadruplets. Thus, the sextuplet lens system of the present invention has the advantages of symmetry and is preferably mounted in two triplets. Other advantages of the lens system of the present invention include the large symmetric demagnification (up to about 100 or more) while maintaining a relatively short total length (about 2 to 4 meters or less) between the triplet lenses, an unexpectedly small symmetric spherical aberration, and the crossover in both planes of focusing. It is estimated that the distance between the last lens and the target position can be approximately 8 to 10 cm. The lens system of the present invention has the capability of changing the demagnification over a wide range from about 1 to greater than 1000 by changing only the excitation of the middle lenses. As previously mentioned, it is also possible to obtain a point crossover between the middle lenses with a corresponding minimum sensitivity to the relative rotation of both triplets around the longitudinal axis. By changing the excitation of the middle lenses, the optimal demagnification for every emittance can be found and for every beam emittance it is possible to achieve a minimum spot size by varying the sizes of collimator diaphragms and the distance between them.

To determine the optimal probe-forming system producing a given beam spot size with maximum beam current, other parameters must be considered, such as the optimal excitations (optimal gradients of electric field), optimal matching slits, and optimal physical geometry of the system.

The following notations can be used for the distances in a microprobe system of n quadrupole lenses: $s_j$ is the spacing between the j-the lens and (j+1)-th lens; $l_j$ is the effective length of the j-th lens; a is the object distance (the distance between the object slit and the first lens; g is working (or image) distance; it is the total length of the system (the distance between the object and the image); $r_1$ is the half-width (or radius) of the object slit; $r_2$ is the half-width (or radius) of the diverging (or aperture) slit; $l_{12}$ is the distance between the object and diverging slits. The length l of the ion-optical system is equal $$l=l_t-a-g$$

The demagnifications in the xoz and yoz planes are $d_1$ and $d_2$, respectively. The dimensionless excitation of the j-th lens is denoted via $x_j$, where $$x_j=\beta_j l_j$$

$B_j$ is a function of the field gradient in the j-th lens.

The Matrix Method of the Numerical Investigation.

The first step of all calculations is solving the linear equations of beam motion for a given geometry of sextuplet. In this way the excitations of the lenses and demagnification are determined. The rectangular model for the distribution of the magnetic induction gradient along the z axis is considered. The matrix method of embedding in the space of the phase moments is used. to solve the non-linear equations of motion. See A. D. Dymnikov and G. M. Osetinskij, Fiz. Elem. Chastits At. Yadra 20 (1989) 694 and Sov. J. Part. Nucl. 20 (1989) 293; and A. D. Dymnikov and R. Helborg, Nucl. Instr. And Meth. A 330 (1993) 343, all of which are incorporated herein by reference. In this method the initial approximate differential equations are replaced by the linear equations in the space of the phase moments with the same approximation accuracy. As a result it becomes possible to use all the advantages of the linear differential equations over non-linear ones, including the independence of the matrizant (the transfer matrix function) on the choice of the initial point of the phase space. If the matrizant of the non-linear motion is known the spherical aberration of the lens system can be determined.

Then by assuming a uniform density of particles in the plane of the two slits, and choosing, by a random method, N particles trajectories, it is possible to obtain the position of these particles in the image plane or in the target (or specimen) plane. If the 3-rd order matrizant is known, the half-width of the spot size, r is defined as the maximum value of the $x_{max}$ and $y_{max}$ of the particles on the target.

A beam will have an envelope surface and all particles of the beam will be located inside of this beam envelope. For the same phase volume (or beam current) the shape of the beam envelope can be different. The beam envelope will be optimal if the spot size on the target has a minimum value for a given emittance, which is defined by a set of two matching slits: objective and divergence slits. For a given emittance, em, the shape of the beam envelope will be the function of the half-width (or radius) $r_1$ of the objective slit and of the distance $l_{12}$ between two slits. The size $r_2$ of the second (divergence) slit is determined by the expression:

$$r_2=eml_{12}/r_1$$

The optimal parameters $r_1$, $r_2$ and $l_{12}$ determine the optimal beam envelope or the optimal matching slits. For optimal matching slits optimal excitations $x_1$, $x_2$ and $x_3$ giving the minimum spot size r are found.

The Sextuplet Lens System of the Present Invention with a Point Intermediate Crossover.

In the sextuplet lens system of the present invention it is possible to obtain a point crossover between the middle lenses with a corresponding minimum sensitivity to the relative rotation of both triplets around the longitudinal axis. For our geometry this system has been found and the smallest beam spot size and appropriate optimal parameters of the collimator slits have been determined for different emittances, which is shown in the Table 1 below.

TABLE 1

| $em = em_x = em_y$[m] | r[$\mu$] |
|---|---|
| $1*10^{-8}$ | 2.974 |
| $5*10^{-9}$ | 1.759 |
| $4*10^{-9}$ | 1.457 |
| $3*10^{-9}$ | 1.184 |
| $2*10^{-9}$ | 0.805 |
| $1*10^{-9}$ | 0.492 |
| $3*10^{-10}$ | 0.199 |
| $1*10^{-10}$ | 0.0863 |

This system has the demagnification d=38.7 and the following coefficients of the spherical aberration: $cs_x/d^3=12.2$ m, $cs_y/d^3=6.9$ m, $cs_{xy}/d^3=cs_{yx}/d^3=18.4$ m.

The Positive Demagnification for Different Excitations of the Middle Lenses.

Figure 2:
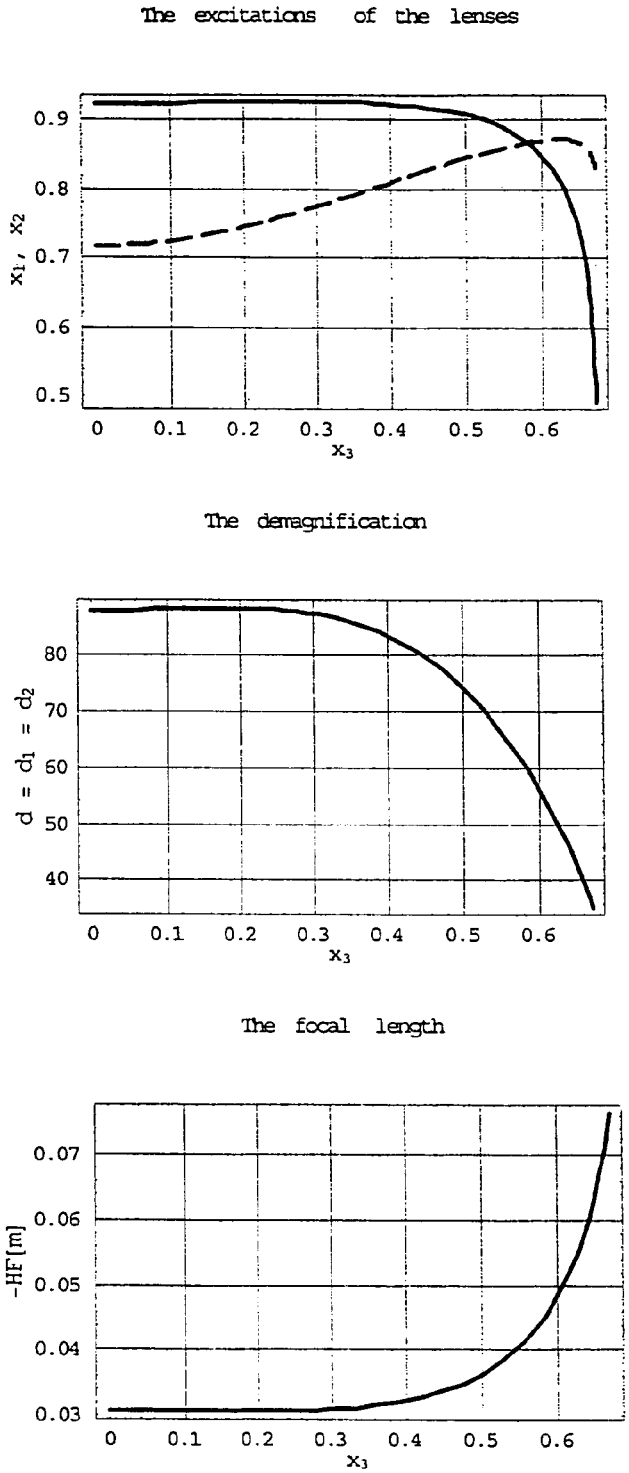
FIG. 2 hereof shows data for the second mode of excitations. The top graph shows the excitation of the lenses wherein the continuous curve is $x_1$ and the dashed curve is $x_2$. The middle graph shows the demagnification and the bottom graph shows the focal length.
Figure 3:
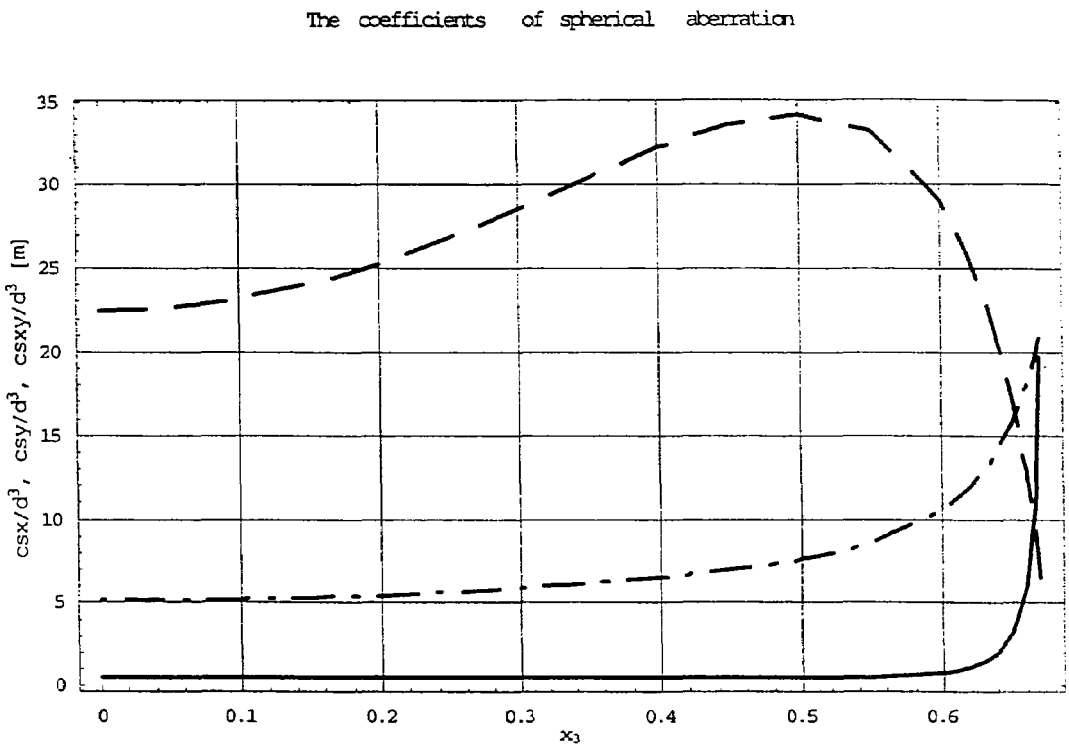
FIG. 3 hereof shows the spherical abberation for the second mode of excitations wherein the dashed curve is $csx/d^3$; the dashed-dotted curve is $csy/d^3$; and the continuous curve is $csxy/d^3$.

For the second mode of the lens excitations the system has one line intermediate crossover in each plane, a positive demagnification, and for the demagnification d=38.7 these two crossovers transform into a one-point crossover. FIG. 2 shows the dependence of the demagnification, the excitations and the focal distance on the excitations of the middle lenses, while in FIG. 3 it is possible to see the dependence of the coefficients of the spherical aberrations on the excitations of the middle lenses. While the dimensionless excitation of the middle lenses changing from 0 to 0.67 the demagnification is decreasing from 88 to 20, the focal distance is growing from 1.2 cm to 5.6 cm.

The Negative Demagnification for Different Excitations of the Middle Lenses.

Figure 4:
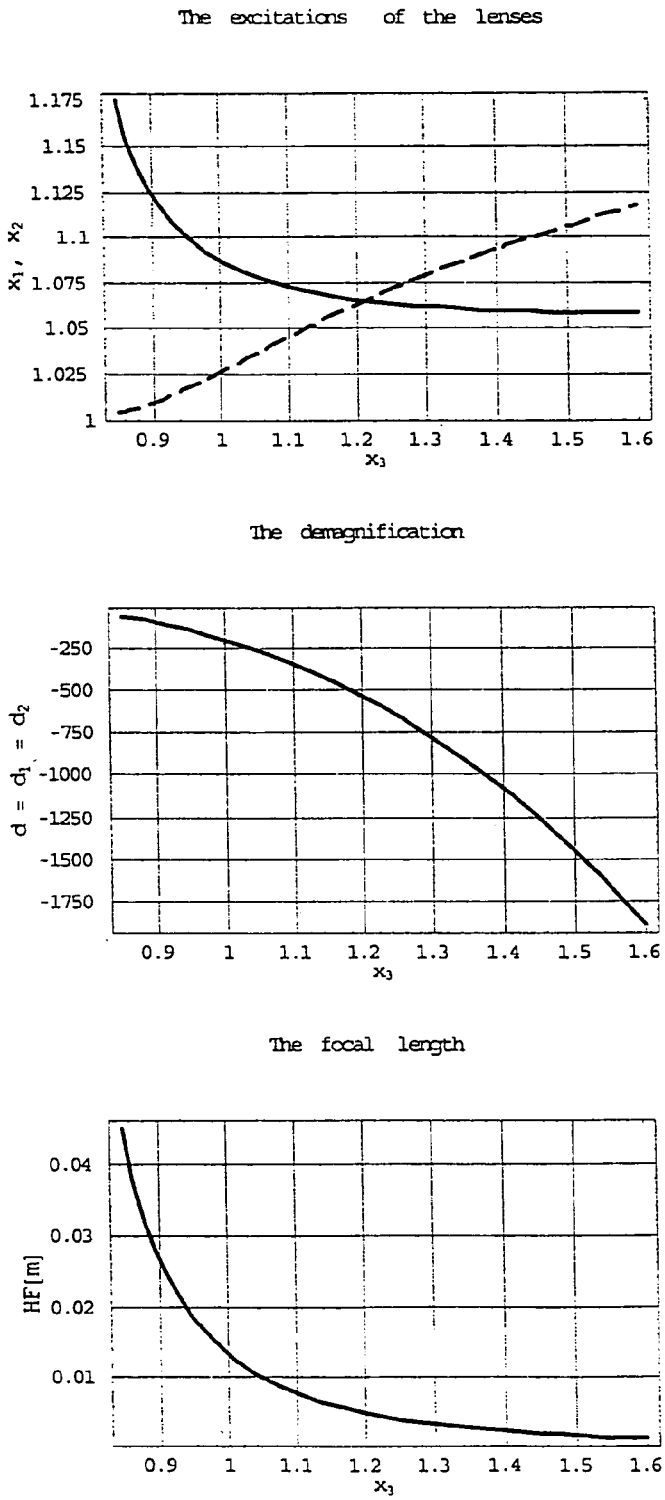
FIG. 4 hereof shows data for the third mode of excitations wherein the top graph is the excitations of the lenses. The continuous curve is $x_1$ and the dashed curve is $x_2$. The middle graph shows the demagnification and the bottom graph shows the focal distance.
Figure 5:
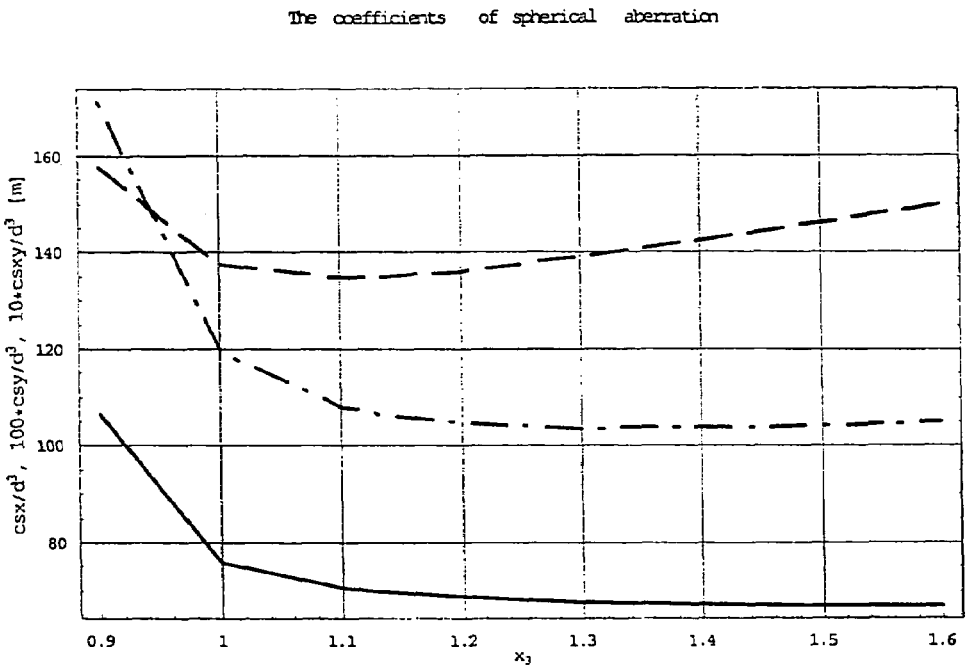
FIG. 5 hereof shows the spherical aberration for the third mode of excitations wherein the dashed curve is $csx/d^3$, the dashed-dotted curve is $csy/d^3$, and the continuous curve is $csxy/d^3$.

For the third mode of the excitations the demagnification is negative and the system has two line crossovers in each plane. For this mode it is possible to change the demagnification over a wide range from 1 to greater than 1000 by changing the excitation of the middle lenses. The excitations of the lenses and the corresponding demagnification, focal distance and spherical aberrations for this case are shown in FIG. 4 and in FIG. 5.

The Sextuplet with Equal Focal Lengths, Demagnifications and Spherical Aberrations.

By the appropriate choice of the excitations it is possible to obtain the special case of the sextuplet as an analogue of an asisymmetrical lens including the spherical aberrations. Some parameters of this system are given in Table 2 below for csx=csy. This is the case when the biggest coefficient of the spherical aberration cs has a minimum value, cs=10 m. For the Oxford Triplet with the same geometry cs=133 m.

| $em = 1*10^{-9}$ m | csx = csy | $x_{3-0}$ | $g_{11} = g_{22}$ | $r_1 = r_2$ |
|---|---|---|---|---|
| $d_1 = d_2 = d$ | 37.28 | 87.94 | 38.69 | −56.67 |
| HF[cm] | −7.25 | −3.07 | −6.98 | 4.766 |
| $csx/d^3$[m] | 9.97 | 22.43 | 12.23 | 205 |
| $csy/d^3$[m] | 9.97 | 0.473 | 6.92 | 2.60 |
| $csxy/d^3$[m] | 19.45 | 5.14 | 18.36 | 31.8 |
| $r_1[\mu]$ | 15.9 | 36.8 | 16.64 | 40.5 |
| $r_2[\mu]$ | 24.2 | 38.4 | 24.59 | 40.5 |
| $l_{12}$ [m] | 0.384 | 1.415 | 0.409 | 1.639 |
| $r[\mu]$ | 0.490 | 0.464 | 0.492 | 0.80 |

Sextuplet Microprobe with Equal Matching Slits.

Figure 6:
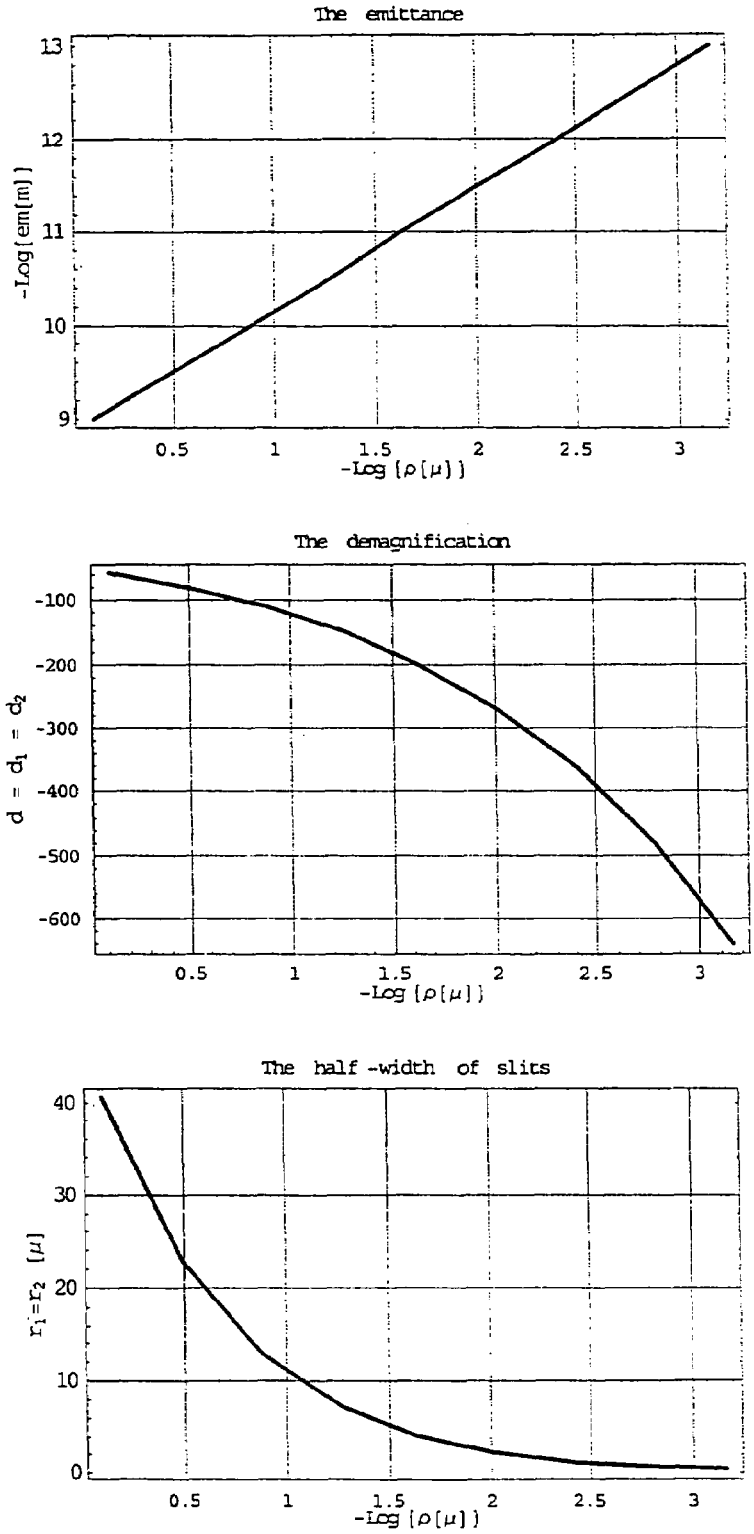
FIG. 6 hereof shows the parameters as a function of the spot size for the sextuplet lens system of the present invention with equal optimal slits wherein the top graph is the emittance, the middle is the demagnification, and the bottom is the half-width of optimal slits.

In a microprobe, for every beam emittance it is possible to find the optimal parameters $r_1$, $r_2$ and $l_{12}$, which determine the optimal beam envelope or the optimal matching slits. In a mircoprobe containing a sextuplet lens system of the present invention, this optimization can be done for different demagnifications. For every emittance there is an optimal demagnification when the optimal slits have the same size $r_1=r_2$. This optimal demagnification and the corresponding excitations, the coefficients of the spherical aberration, the focal distance, the parameters of the optimal matching slits and the spot size on the target for $em=10^{-9}$ m are given in the Table 2 above. For different spot size the corresponding emittance, the optimal demagnification and the optimal size of the equal slits are shown in FIG. 6. It is worth to note that the optimal distance between the two slits is obtained the same for different emittances.

Comparison of the Sextuplet Lens Microprobe for Different Excitation of the Middle Lenses.

In the Table 2 the results of calculations for different middle excitation $x_3$ are presented and the demagnification, the coefficients of the spherical aberration, the parameters of the optimal matching slits and the spot size are shown for em=10−9 m. The first column shows the parameters of the system with equal spherical aberrations in both planes (csx=csy). In the second column there are the data of one partical case of sextuplet microprobe system with $x_3=0$, corresponding to the case of the Russian Quadruplet. In the third column it is possible to see the parameters for the sextuplet system with the intermediate point crossover ($g_{11}=g_{22}$). Here $g_{11}$ and $g_{22}$ are the distances between the third lens and the line intermediate crossover in the planes x0*z* and y0*z* correspondingly. The data in the fourth column show the parameters for the system with equal slits. The first three columns show the systems with the second mode of excitations. In the last column there are the data for the system with the third mode of excitations. It is possible to see that the spherical aberrations and the spot size for the third mode are bigger than for the second mode.

What is claimed is:

1. A quadrupole lens system comprised of six quadrupole lenses in a linear configuration comprised of two triplets, such that:

i) the focusing (F) and defocusing (D) capabilities of the lenses in one plane alternate F-D-F-D-F-D; and ii) the lens emittances are ordered A-B-C—C-B-A; and iii) the lengths of the lenses ($l_j$) and the distances between lenses ($s_k$) are ordered as $l_1$-$s_1$-$l_2$-$s_2$-$l_3$-$s_3$-$l_3$-$s_2$-$l_2$-$s_1$-$l_1$; and iv) every two identical lenses are rotated 90 degrees from each other.

2. The quadrupole lens system of claim 1 wherein each lens is a magnetic lens.

3. The quadrupole lens system of claim 1 wherein each lens is an electrostatic lens.

4. The quadrupole lens system of claim 1 wherein the lens are any combination of lens selected from magnetic lenses and electrostatic lenses.

5. The quadrupole lens system of claim 1 wherein the spherical aberration coefficients of the lens system are substantially equal.

* * * * *